US011471710B2

(12) United States Patent
Sangirardi

(10) Patent No.: US 11,471,710 B2
(45) Date of Patent: Oct. 18, 2022

(54) PROTECTIVE COVER FOR EMERGENCY WORKER OXYGEN TANK

(71) Applicant: Nicholas W. Sangirardi, Babylon, NY (US)

(72) Inventor: Nicholas W. Sangirardi, Babylon, NY (US)

( * ) Notice: Subject to any disclaimer, the term of this patent is extended or adjusted under 35 U.S.C. 154(b) by 586 days.

(21) Appl. No.: 15/234,850

(22) Filed: Aug. 11, 2016

(65) Prior Publication Data

US 2017/0043191 A1 Feb. 16, 2017

Related U.S. Application Data

(60) Provisional application No. 62/282,859, filed on Aug. 14, 2015.

(51) Int. Cl.

| | |
|---|---|
| ***A62B 9/04*** | (2006.01) |
| ***A62B 25/00*** | (2006.01) |
| ***A62B 5/00*** | (2006.01) |
| ***A61G 1/007*** | (2006.01) |

(52) U.S. Cl.

CPC ..... *A62B 9/04* (2013.01); *A62B 25/00* (2013.01); *A61G 1/007* (2013.01); *A62B 5/00* (2013.01)

(58) Field of Classification Search

CPC .. A62B 9/04; A62B 25/00; A62B 5/00; A61G 1/007; A45F 2003/142; A45F 3/14; B60R 22/04; B60R 22/105

USPC ..... 220/724; 217/61, 62

See application file for complete search history.

(56) References Cited

U.S. PATENT DOCUMENTS

| | | | | |
|---|---|---|---|---|
| 3,912,328 | A * | 10/1975 | Tanaka | B60R 22/105 24/196 |
| 4,103,806 | A * | 8/1978 | White | B65D 83/40 220/724 |
| 4,253,454 | A | 3/1981 | Warncke | 128/202.26 |
| 5,253,885 | A * | 10/1993 | McCracken | B62B 15/00 280/19 |
| 5,393,080 | A | 2/1995 | Ross | 280/47.26 |
| 5,573,211 | A * | 11/1996 | Wu | B62B 1/06 248/230.8 |
| 5,647,784 | A * | 7/1997 | Moran | B63B 35/7906 114/357 |
| 5,947,351 | A * | 9/1999 | Garofalo | A45F 3/04 224/153 |
| 6,521,309 | B1 * | 2/2003 | Chen | C09J 7/38 428/40.1 |

(Continued)

*Primary Examiner* — Anthony D Stashick
*Assistant Examiner* — James M Van Buskirk
(74) *Attorney, Agent, or Firm* — Ernest D. Buff & Associates, LLC; Ernest D. Buff

(57) ABSTRACT

A protective cover for an emergency worker oxygen tank has a rigid protective cover member with a knob protection portion and a tank attachment member. The tank attachment member is fixedly attached to the rigid cover member. The tank attachment member is capable of being securely attached to a portion of a standard oxygen tank or a portion of the frame supporting said oxygen tank used by emergency workers. The oxygen tank is commonly strapped onto the emergency worker's back via a standard rigid frame. The rigid protective cover member includes a knob protection portion that is appointed to extend around and over an adjustment knob portion of the oxygen tank to prevent damage and facilitate transport.

12 Claims, 11 Drawing Sheets

(56) References Cited

U.S. PATENT DOCUMENTS

| | | | | |
|---|---|---|---|---|
| 6,824,150 | B2 | 11/2004 | Simione | 280/47.34 |
| 6,845,533 | B1 | 1/2005 | Tulette | 5/626 |
| 7,394,387 | B2 | 7/2008 | Noonchester | 340/573.1 |
| 8,035,525 | B2 | 10/2011 | Noonchester | 340/573.1 |
| 8,470,279 | B2 * | 6/2013 | Hinman | C01B 21/0685 423/335 |
| 2004/0050384 | A1 | 3/2004 | Stein | 128/200.23 |
| 2007/0163047 | A1 * | 7/2007 | Noonchester | A62B 3/00 5/626 |
| 2011/0042109 | A1 * | 2/2011 | Bouthiette | A62B 7/02 169/43 |
| 2011/0298251 | A1 * | 12/2011 | McLoughlin | A62B 25/00 297/188.04 |
| 2013/0193824 | A1 * | 8/2013 | Koenig | A47B 88/493 312/334.11 |
| 2017/0325292 | A1 * | 11/2017 | Bench | H05B 3/46 |

* cited by examiner

PROTECTIVE COVER FOR EMERGENCY WORKER OXYGEN TANK

CROSS REFERENCE TO RELATED APPLICATIONS

This application claims the benefit of U.S. provisional patent application No. 62/282,859 filed Aug. 14, 2015, for "Protective Cover For Emergency Worker Oxygen Tank", the disclosure and priority of which is hereby incorporated in its entirety by reference thereto.

FIELD OF THE INVENTION

The present invention relates to accessories for emergency worker oxygen tanks; and, more particularly, to a protective cover for emergency worker oxygen tanks.

DESCRIPTION OF THE PRIOR ART

Self-contained breathing devices or SCBAs are used by emergency workers such as fire fighters, first aid, first responders, industrial hazard workers, military rescue personnel, and other individuals who enter into highly hostile environments. In some cases these personnel accidentally get caught in the environment, such as during a fire when a floor collapses and causes a fire fighter to fall to a basement area where he or she must be extracted by another emergency worker. In this case, the trapped emergency worker must be quickly dragged out of harm's way.

Often this includes dragging the emergency worker, on his or her back, up or down a flight of stairs. This procedure is hindered by the fact that the control knobs of the oxygen tank being worn by the downed worker can get hung up on the stairs, thereby requiring an additional emergency worker to lift up the bottom tank portion as the downed worker is being slid along. Additionally, the total weight of a downed emergency worker including his or her gear can weigh in excess of 300 pounds making it difficult for a single emergency worker to extricate a downed emergency worker. Based on the above criteria, it would be a great benefit to have a method of protecting the adjustment knob portion of the oxygen tank worn by an emergency worker. It would also be a great benefit to reduce the frictional forces required to pull a downed emergency worker to safety. Finally, it would be a great benefit to have the protection device by as small and light weight as possible so as not to hinder the emergency worker during his or her normal emergency work.

Others have given thought to these issues and proposed various solutions. Relevant patent examples of this are:

U.S. Pat. No. 4,253,454 to Warncke discloses a respirator package for carrying on a person, including a tubular frame which forms a container for a high pressure gas such as oxygen. A respiratory air circulating system is adapted to be mounted on the frame and connected to the high pressure gas therein for the selected circulation of the gas and respiratory air to and from the wearer and also advantageously includes means for regenerating the breathing air and supplementing it with the gas. The high pressure gas container comprises a frame made up of successive windings of a tube to form a closed container having a connecting valve associated therewith. The frame thus formed is provided with straps so that the frame can be carried on a wearer's back, and it provides a spacing and insulation for a breathing system, which includes a regenerator that is likely to heat during operation. The parts of the system are held in place on the frame by means of a casing which is secured to the frame. The device is not appointed to attach onto a rescue personnel oxygen tank itself and it does not include tracks for actually transporting a person.

U.S. Pat. No. 5,947,351 to Garofalo et al. discloses a cylinder carrier that includes a sleeve and an extension, the extension being slidably retained within the sleeve. A handle is disposed at a free end of the extension. The sleeve has a first end near the handle and a second end opposite the first end. A pair of cylinder rests is provided, one each of the rests being positioned on each of two opposite sides of the sleeve at the second end of the sleeve. The cylinder rests are foldable against the sleeve. A pair of cylinder straps is disposed on each side of the sleeve. Each pair of cylinder straps is adapted for holding a cylinder to the post, such that a distal end of the cylinder rests against one of the cylinder rests. The cylinder straps are foldable against the sleeve. A pair of shoulder straps is attached to the post for wearing the post on a human back. A pair of wheels is disposed at the second end of the sleeve. The post is inscribed with indicia indicating an empty cylinder near the first end of the sleeve, and indicia indicating a filled cylinder near the second end of the sleeve. A person can place the cylinder within the cylinder with a neck of the cylinder disposed near the first end or the second end of the sleeve, to indicate whether the cylinder is empty or filled. The carrier does not cover the knobs of the tank and cannot be used to transport a person.

U.S. Pat. No. 6,824,150 to Simione discloses a cart for the transportation of personnel and equipment in a fire or other hazardous environment. The cart is constructed out of fire protective material and designed to float. There are wheels on the bottom surface, which are placed and designed to be able to be operative over very uneven surfaces. The structure also has the ability to store fire equipment and in addition on the top surface a fully dressed firefighter with a Scott Air Pack. The cart has handles, which can be adjusted so as to be folded into different locked positions based on the particular usage conditions. This design requires that a bulky piece of equipment be stored on the emergency vehicle and be accessed and brought to the scene in a timely fashion. In emergency situations, seconds count, and the time needed to bring this piece of equipment to the needed area may mean the difference between life and death.

U.S. Pat. No. 6,845,533 to Tulette discloses a patient transport board comprising a flat, rigid board having a surface on which the patient lays, and restraining straps for securing the patient. A pair of foldable rail members can be extended to serve as runners for moving the patient down a flight of stairs. A skid plate is provided at the foot end of the board to allow the board to be used in an upright mode for maneuvering in tight areas. In one embodiment wheel and axle assemblies are affixed at the lower end of the rail members to make easier movement of the patient transport board in an upright orientation. In another embodiment, track assemblies allow for movement over rough or uneven surfaces when the patient transport board is in an upright orientation. Components of the patient transport board are foldable or removable so the board can be readily placed on a gurney or stored. This is the type of additional piece of equipment that may not be immediately available in an emergency and it is not readily attached to an oxygen tank.

U.S. Pat. Nos. 7,394,387 and 8,035,525 to Noonchester discloses rescue devices that attach to the frame of a self-contained breathing apparatus carried on the back of emergency workers such as firemen, hazardous-waste cleanup crews, and other individuals entering into hostile environments. The rescue devices are adapted to connect to the frame of existing self-contained breathing apparatus frames or racks. In one form, the rescue device has a top and bottom frame which connects to the SCBA frame at the top and bottom locations. The frames project around the body of the SCBA tank and extend out to position rolling elements for providing the transportation needs. The frames have at the rolling elements' ends wheel forks which contain wheels having axles. In another embodiment a skid plate is attached to the ends of the frames in conjunction with the protruding wheels or by itself without rolling elements. Other ways of creating the reduction in frictional drag are provided such as a sled type configuration and a track system. However, the proposed devices do not protect the knob area of the oxygen tank. Moreover, the attachment methods disclosed involve screwing metal brackets onto the SCBA frame, which in turn support rollers or a sled that may damage the frame. Additionally, some frames are constructed of wire forms and do not lend themselves to having brackets supported to them. Finally, the designs shown tend to be bulky and may get in the way when working in close quarters during an emergency.

Accordingly, there exists a deficiency in the prior technology in that none of the prior designs adequately protects the knob portion of the oxygen tank during an emergency extraction, and all of the prior designs tend to be either additional pieces of equipment that must be transported from the emergency vehicle to the scene of the emergency, or bulky additions to the SCBA of the emergency worker that may interfere with the worker's efforts when in close quarters.

SUMMARY OF THE INVENTION

The present invention provides a protective cover for an emergency worker's oxygen tank that protects the adjustment knob portion of the tank from damage when extracting the worker from a dangerous situation such as in a house or commercial structure fire, or a below grade or above grade rescue operation.

An object of the invention is to provide a protective tank cover that acts to lessen frictional forces when dragging an injured emergency worker from a dangerous environment.

Another object of the invention is to provide a protective tank cover that can be removed and replaced.

A further object of the invention is to provide a protective tank cover that does not add excessive weight or bulk to the tank.

Other objects and advantages of the present invention will become apparent from the following descriptions, taken in connection with the accompanying drawings, wherein, by way of illustration and example, an embodiment of the present invention is disclosed.

Briefly stated, in accordance with a preferred embodiment of the invention, there is disclosed a protective cover for emergency worker oxygen tank, comprising: a rigid protective cover member, a tank attachment member, said tank attachment member fixedly attached to said rigid cover member, said tank attachment member capable of being securely attached to a portion of a standard oxygen tank or to a portion of the supporting frame for said oxygen tank used by emergency workers, said oxygen tank commonly strapped onto said emergency worker's back via a standard rigid frame, and said rigid protective cover member extending around and over the adjustment knob portion of said tank.

In another embodiment, there is provided a protective cover for an emergency worker oxygen tank, comprising:

a) a rigid protective cover member having a main body portion, a neck portion and a knob cover extension portion, said rigid protective cover adapted to receive and extend around at least a portion of an oxygen tank;

b) a tank attachment member fixedly integrated with said rigid cover member, said tank attachment member adapted to be securely attached to a portion of a standard oxygen tank appointed to be used by an emergency worker; and c) said knob protection portion adapted to extend around and over at least a portion of an adjustment knob portion of said oxygen tank to protect said adjustment knob portion.

Preferably, the cover includes a pair of elongated brackets fixedly attached to either side of said oxygen tank, and a mating pair of elongated brackets fixedly attached to an inside portion of said attachment member. With this construction, the attachment member brackets are adapted to slide onto said tank brackets to secure the attachment member to the oxygen tank. In another embodiment, low friction strips are located on the outside of the cover to facilitate gliding along a surface, such as the ground or steps.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

During emergency situations emergency workers such as firefighters and/or EMTs must wear/transport compressed gas cylinders such as oxygen tanks on their backs, and/or must pull or carry the compressed gas cylinders, or oxygen tanks, behind them. As discussed herein throughout the specification and claims, the terms "compressed gas cylinder" and "oxygen tank" are used interchangeably to mean a tank that contains air, or a mixture of oxygen with nitrogen and other gasses appointed for use in connection with an emergency rescue operation. Frequently, oxygen tanks are located on a standard rigid frame which in turn can be strapped onto an emergency worker's back. The standard rigid frame typically includes rails so that the frame, tank and emergency worker can be pulled along a surface such as the ground or stairs. Unfortunately, frequently the adjustment knob portion of the oxygen tank slams against the surface, causing damage to the adjustment knob portion while also causing snagging or catching on articles and surface abutments. It has been surprisingly and unexpectedly found that covering at least a portion of the adjustment knob portion during slide transport prevents the adjustment knob from snagging or catching on surfaces and protects the knob from damage, while still providing the ability to readily access the adjustment knob as needed when extracting an emergency worker from a dangerous situation, such as in a house or commercial structure fire.

Figure 1:
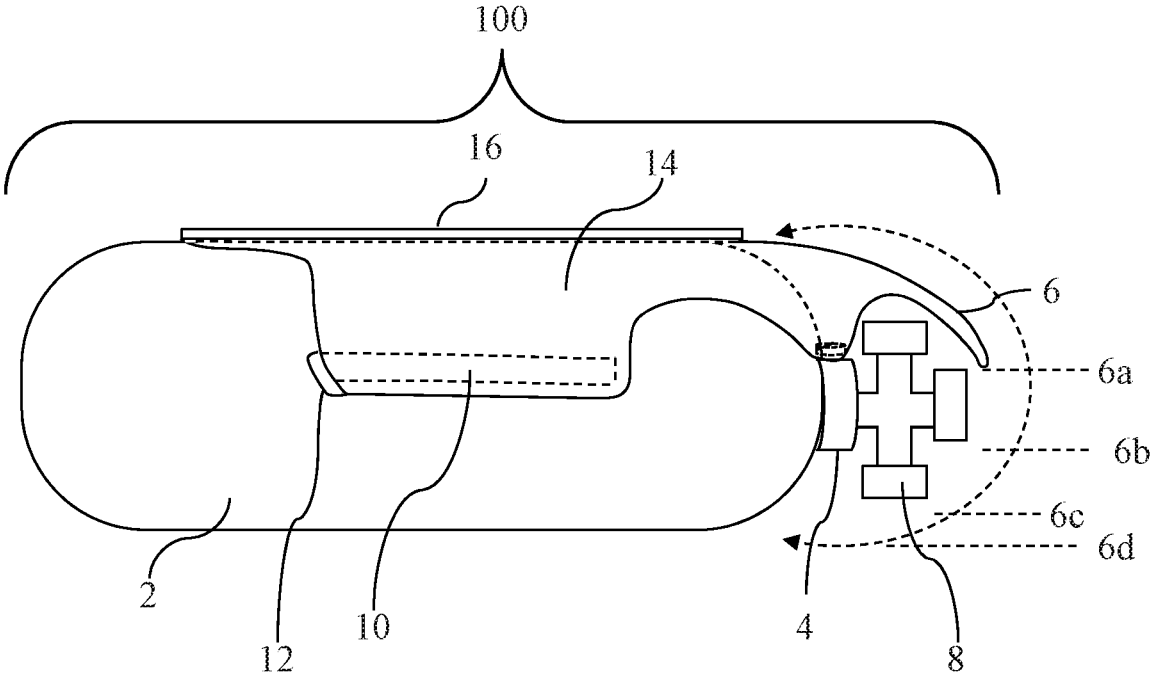
FIG. 1 is a side view of the first embodiment of the invention.

Referring now to FIG. 1, a side view of an embodiment of the protective cover of the present invention is shown generally at 100. The cover 100 comprises a tank holding portion 14 and a knob protection portion 6. The knob protection portion 6 is preferably formed as an arced portion having a cupped interior that is adapted to receive and cradle the adjustment knob of the oxygen tank. In this manner, the adjustment knob fits inside the portion 6. At the same time, preferably knob protection portion 6 is formed so that it extends over at least a portion of the adjustment knob, extending to phantom lines 6*a*, 6*b*, 6*c*, or 6*d*. It is noted that wherein only a portion of the adjustment knob is covered by portion 6, such as shown at 6*a*, 6*b* and 6*c*, access is readily provided so that the adjustment knob can be readily adjusted without having to remove portion 6 from the oxygen tank. In this manner, preferably knob protection portion 6 only covers a portion of the knob adjustment so that the knob is protected, yet access to the knob is readily apparent. Wherein portion 6 extends to phantom line 6*d*, substantially the entire adjustment knob is contained within portion 6, and as a result preferably portion 6 is attached to the main body of the cover by way of a hinge so that it can be opened for access to the adjustment knob.

Figure 3:
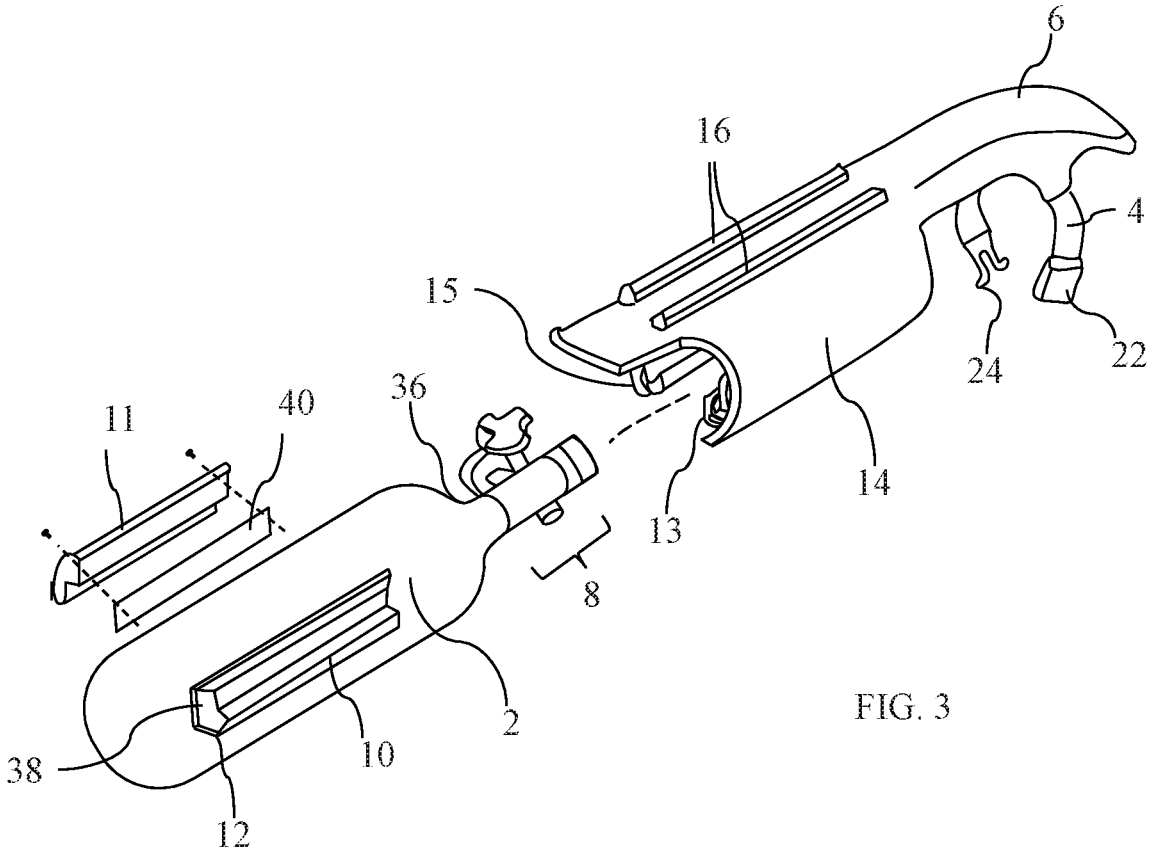
FIG. 3 is an exploded view of the first embodiment of the invention.
Figure 4:
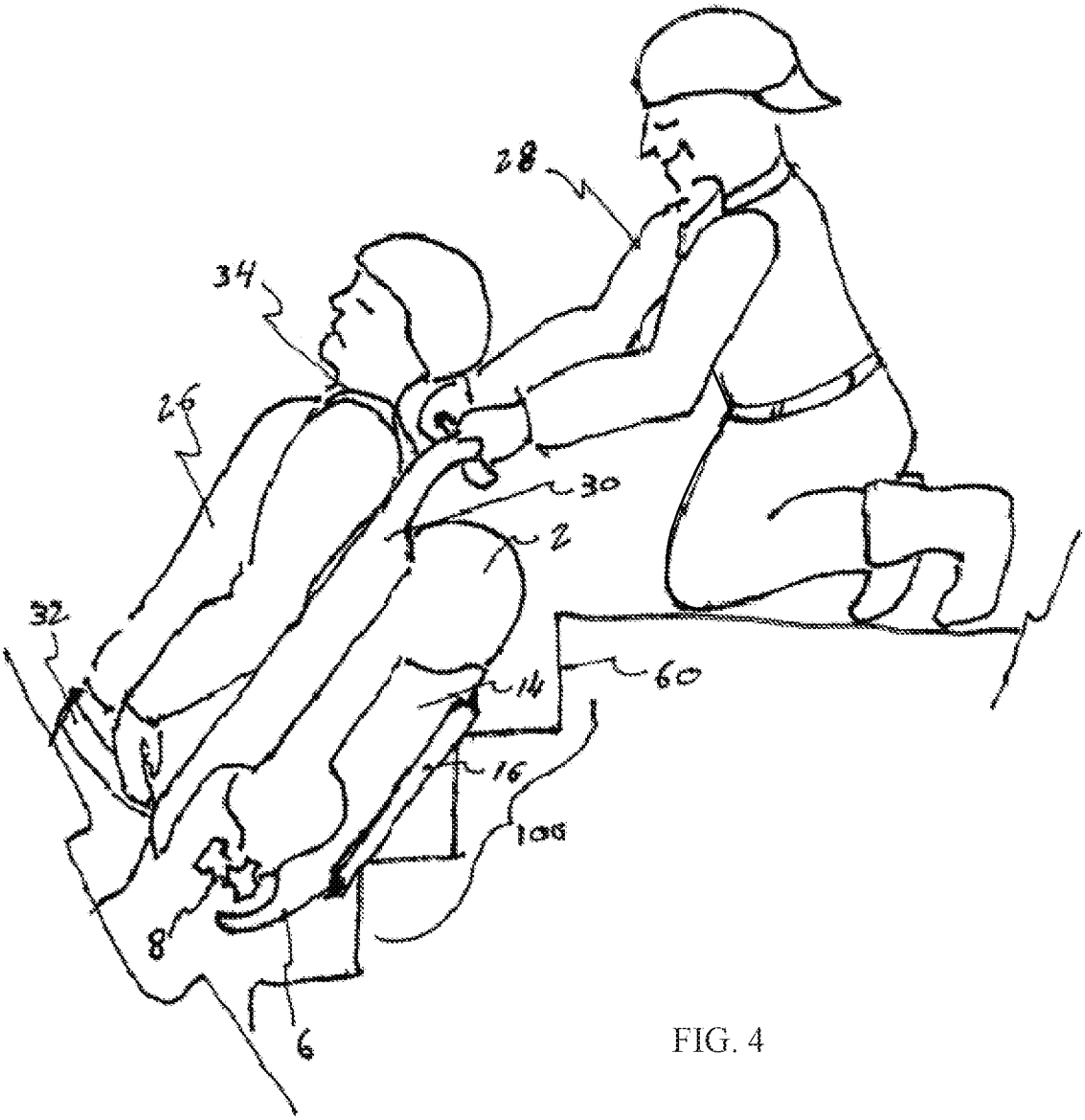
FIG. 4 is a perspective view of the invention in use.

Preferably, the tank holding portion 14 is held onto the tank 2 by a tank attachment member system 10, 11, 13, 15 comprising a pair of pair of rails 10, 11 adapted to be fixedly attached to either side of tank 2 and a mating pair of rails 13, 15 that are fixedly attached to an inside portion of tank holding portion 14 that are adapted to slide onto the rails 10, 11 to secure the tank holding portion 14 to the tank 2, as shown in the exploded view in FIG. 3. The rails 10, 11 are held onto tank 2 via heat resistant double sided adhesive tape 38, 40 shown in FIG. 3, such as a fiberglass based tape made by CS Hide part number HTT-174508-36, which has a temperature rating of 500 degrees F. The tank holding portion 14 and knob protection portion 6 is made of rigid material such as formed metal sheet or high temperature rated plastic such as Nylon 6-6 which has a height temperature rating of 560 degrees F. Low friction slide rails 16 are mounted on the side of the tank holding portion 14 that would be in contact with the ground, or stairs as shown in FIG. 4. Referring back to FIG. 1, the tank holding portion 14 and knob protection portion 6 is also held in place by flexible strap 4. Strap 4 can be released and attached by standard fastening clip 22, 24 as shown in FIG. 3. Rail stop 12 prevents the tank holding portion 14 from accidentally sliding backward.

Figure 2:
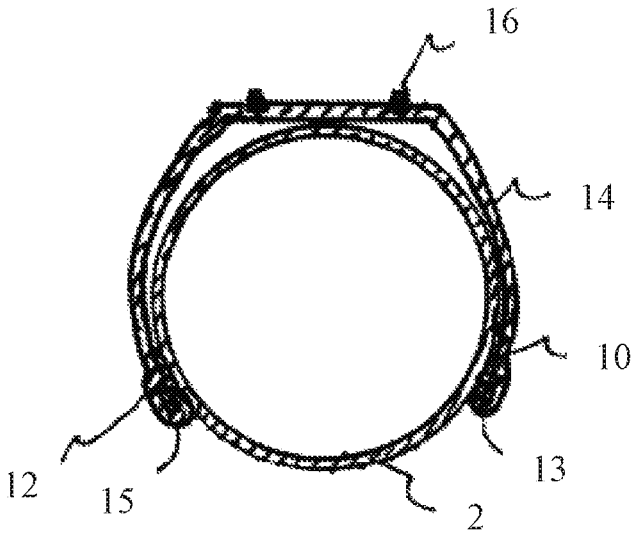
FIG. 2 is a front sectional view of the first embodiment of the invention.

FIG. 2 is a front sectional view that bisects tank 2 of the first embodiment of the invention 100. It can be seen that the cover 14 is in close proximity to the tank 2 and therefore will not get in the way during the course of use in emergency activities.

FIG. 3 is an exploded view of the first embodiment of the invention as explained above. Tank neck 36 is clearly seen as well as knob assembly 8 which is protected by cover portion 6.

FIG. 4 is a perspective view of a person 28 dragging a downed emergency worker 26 up a flight of stairs 60. The emergency worker 28 is pulling on the upper portion of the standard frame 30 that emergency workers use to carry oxygen tanks 2 and other equipment. The frame 30 is held on by standard straps 32, 34. As shown, the emergency worker 28 is being assisted in pulling the downed worker 26 because of low friction slid rails 16 as they engage the stair steps 60. The rails are constructed of material that has a low coefficient of friction such as Teflon. The tank 2 is protected by cover member 14 and the tank adjustment knobs 8 are protected by cover member 6.

Figure 5:
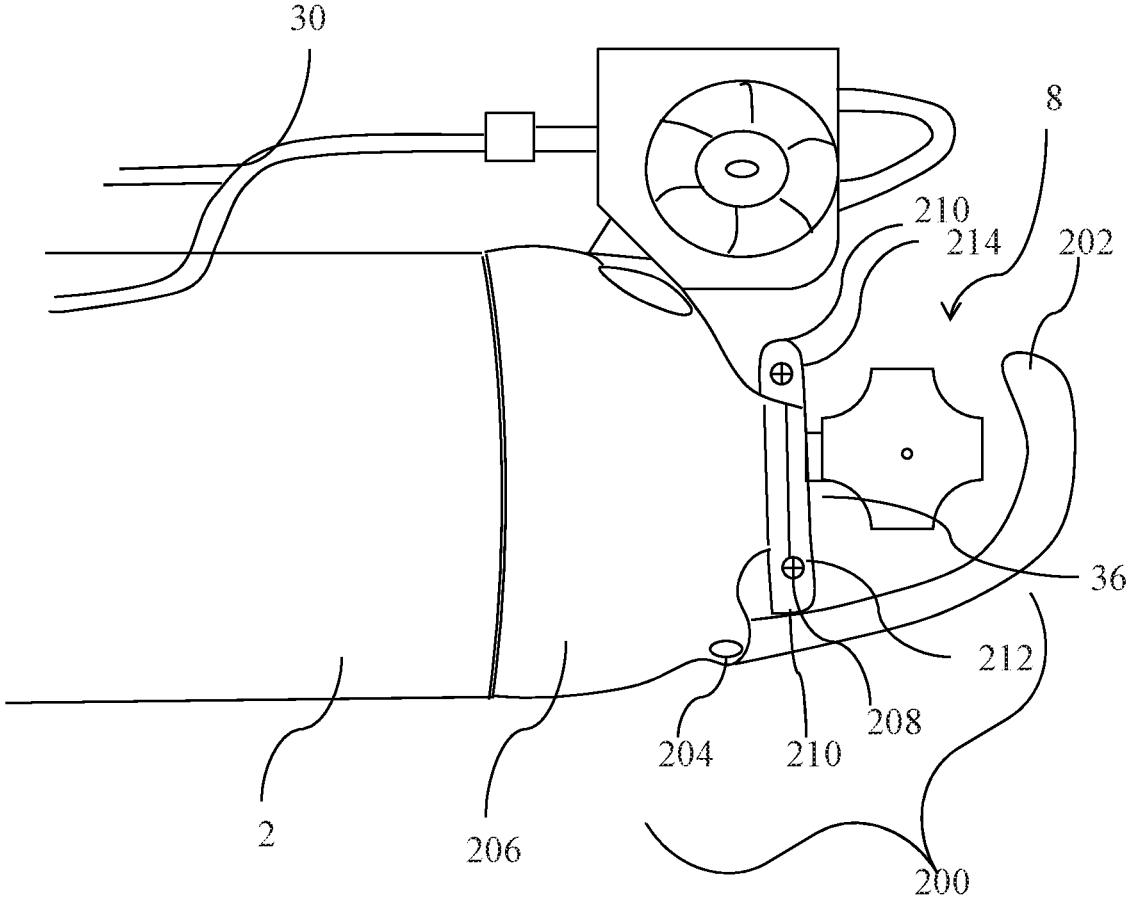
FIG. 5 is a side view of a second embodiment of the invention.

FIG. 5 is a side view of a second embodiment of the invention 200. In this embodiment a cover member 206 is held onto tank 2 via two attachment bolts 208, 210 that clamp onto tank neck 36. Protective panel 202 covers tank adjustment knobs 8. Extension tab 212 acts as a stop to make sure that panel 202 does not deform during use and hit knob assembly 8. Protective panel 202 can be swung away from knob assembly 8 via hinge member 204, allowing a user to have free access to the knobs 8.

Figure 6:
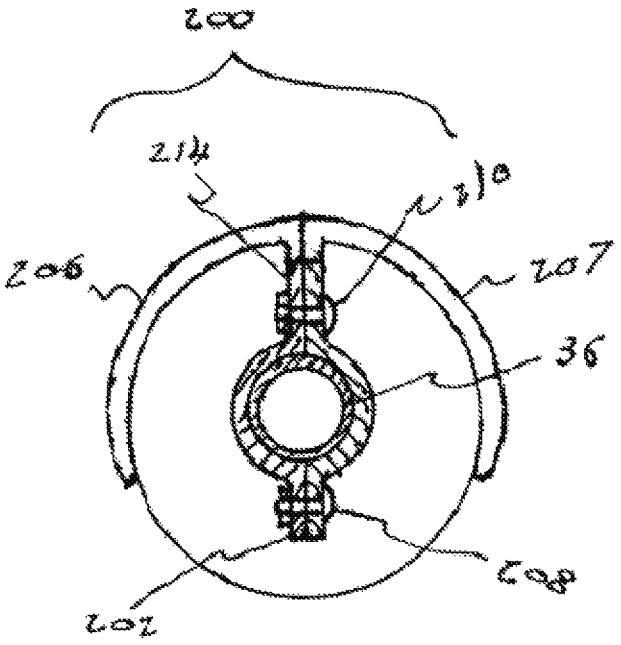
FIG. 6 is a front sectional view of the second embodiment of the invention.

FIG. 6 is a cross section view as defined by section line 210 shown in FIG. 5. This section view shows that the main cover is made from two halves 206, 207 which are bolted together around tank neck 36 by bolts 208, 210.

Figure 7:
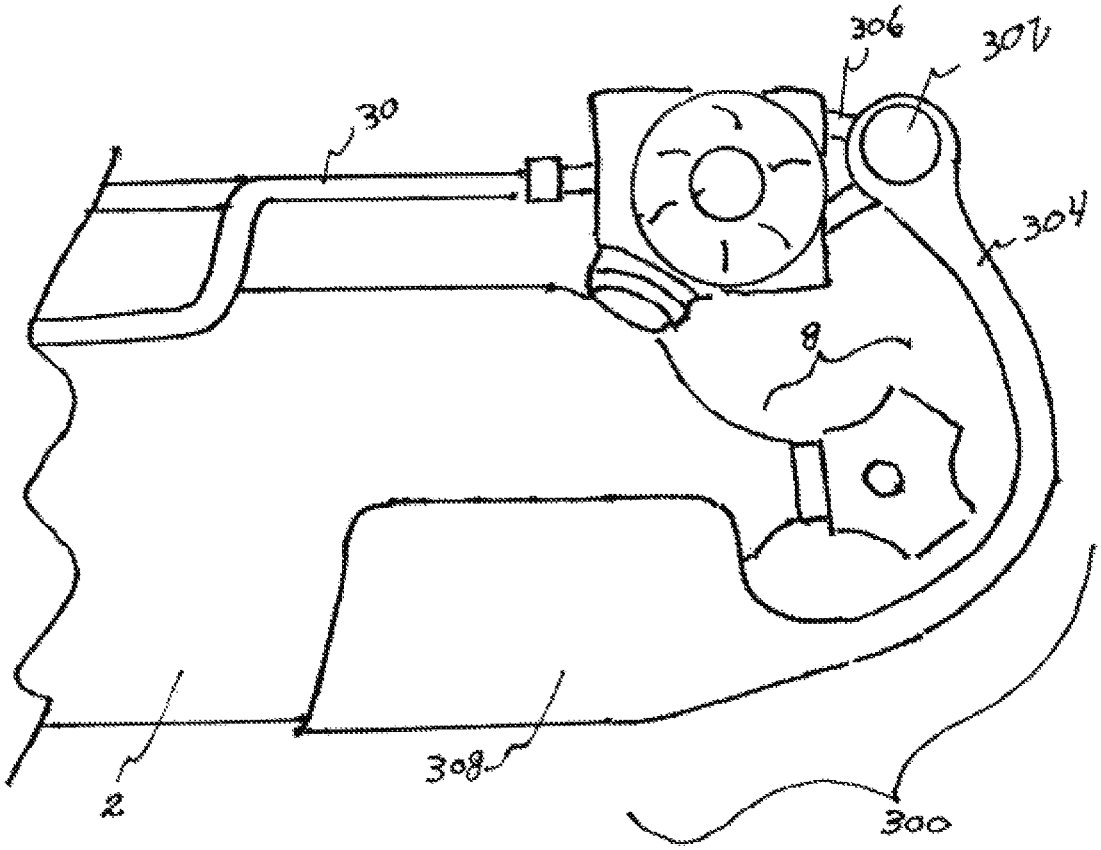
FIG. 7 is a side view of a third embodiment of the invention in the attached position.
Figure 8:
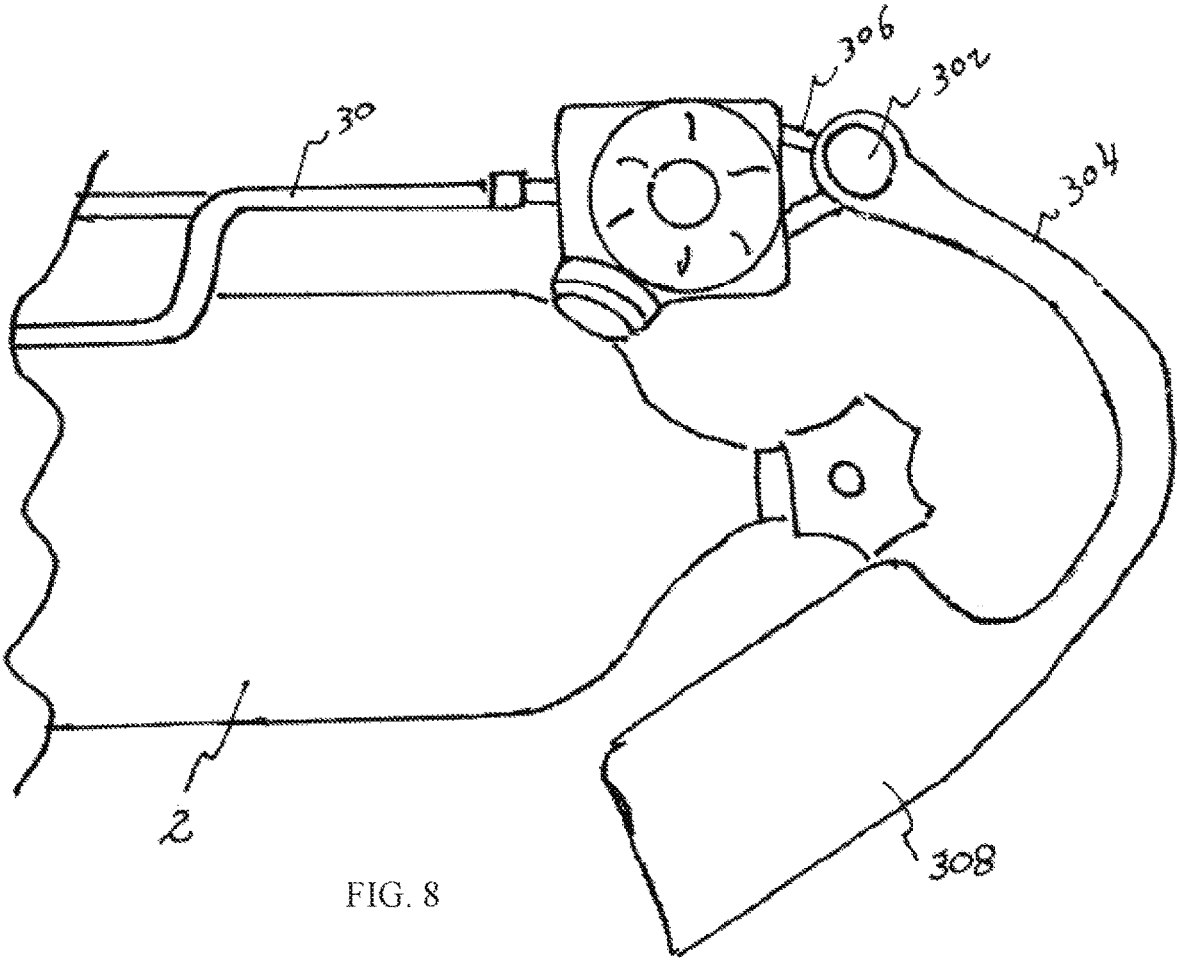
FIG. 8 is a side view of the third embodiment of the invention in the detached position.

FIG. 7 is a side view of a third embodiment of the invention 300. In this embodiment, the main protective cover 308 his held in place at hinge point 302. The hinge member 302 is attached to a triangular portion 306 of the standard frame 30. The curved portion 304 of the cover 300 protects knob assembly 8. The user can have complete access to knob assembly 8 by swinging away the protective cover 300 as shown in FIG. 8.

Figure 9:
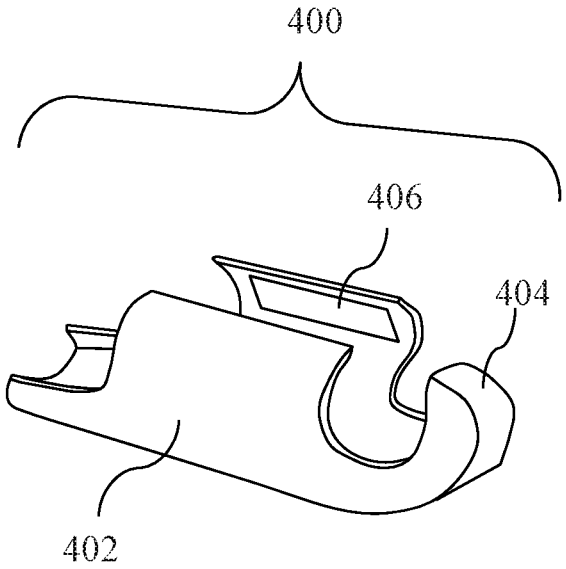
FIG. 9 is a perspective view of a fourth embodiment of the invention.
Figure 10:
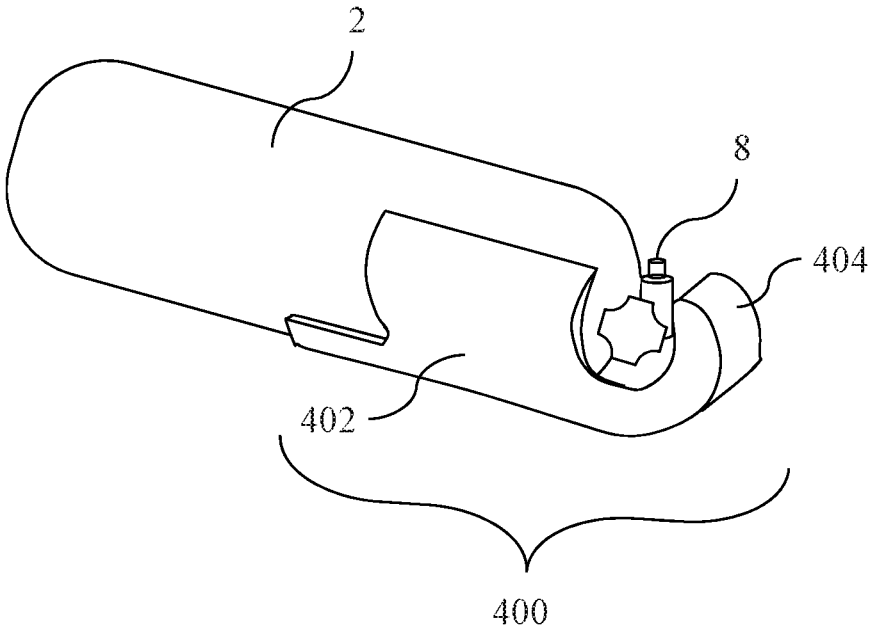
FIG. 10 is a perspective view of the fourth embodiment of the invention in place on an Oxygen tank.

FIG. 9 is a perspective view of a fourth embodiment of the invention 400. This embodiment is meant to be permanently attached to tank 2 via high temperature tape 406. The cover 400 can be made of rigid material including welded metal, or high temperature molded nylon 6-6. The main body 402 attaches to the main portion of the tank 2 and the forward portion 404 protects the knob assembly 8 of the tank 2 as shown in the perspective view in FIG. 10.

Figure 11:
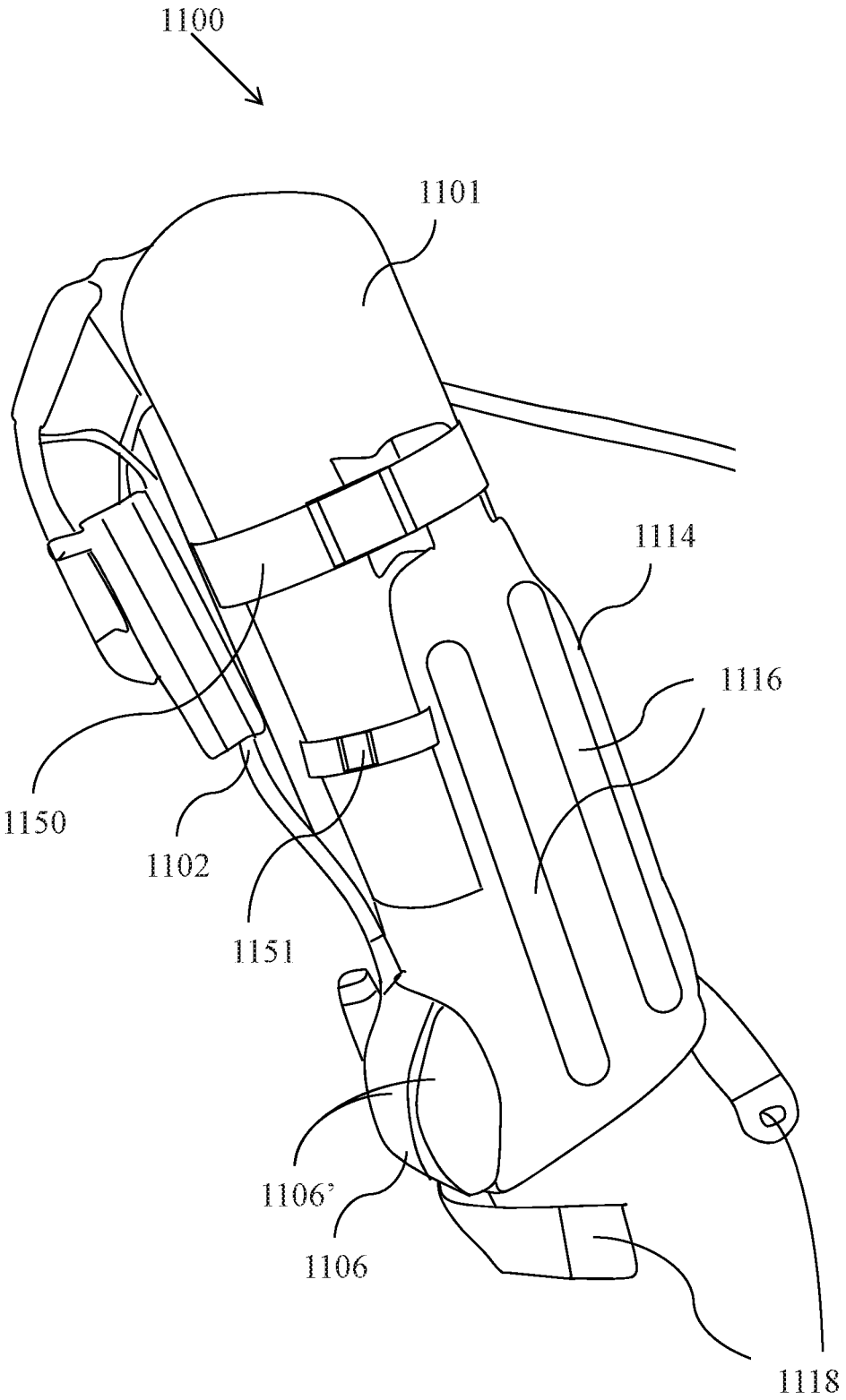
FIG. 11 is a perspective view of an embodiment of the invention in place on an Oxygen tank.

Referring now to FIG. 11, a front perspective view of an embodiment of the protective cover of the present invention is shown generally at 1100. The cover 1100 comprises a tank holding portion 1114 and a knob protection portion 1106 on an oxygen tank 1101 secured to a rigid tank frame 1102. The knob protection portion 1106 is preferably formed as an arced portion having a cupped interior that is adapted to receive and cradle the adjustment knob of an oxygen tank 1101. In this manner, the adjustment knob fits inside the portion 1106. In the embodiment shown, portion 1106 includes reflective sections 1106' for further safety of the emergency worker. The cover 1100 is secured to the rigid tank frame 1102 and oxygen tank 1101 by way of straps 1150, 1151. Low friction slide rails 1116 are mounted on the side of the tank holding portion 1114 for sliding contact with the ground, or stairs. Straps 1118 with mating buckles are provided in relation to said knob protection portion 1106 to further secure the cover on the worker's back for added safety and support.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the subjoined claims.

What is claimed is:

1. A protective cover for an emergency worker oxygen tank having an adjustment knob, comprising:

a) a rigid protective cover member comprising a tank holding portion and a knob protection portion, said knob protection portion having an extension tab configured to operate as a stop to prevent said knob protection portion from contacting said adjustment knob during use;

b) a tank attachment member;

c) said tank attachment member fixedly attached to said rigid protective cover member;

d) said tank attachment member adapted to be securely attached to a portion of a standard oxygen tank or to a portion of a supporting frame for said oxygen tank appointed to be used by an emergency worker;

e) said knob protection portion adapted to extend around and over an adjustment knob portion of said oxygen tank, said knob protection portion having an arced shape and a cupped interior, and being adapted to receive and cradle said adjustment knob portion to thereby extend over only a portion thereof and provide access to said adjustment knob so that said adjustment knob can be adjusted without having to remove said knob protection portion from said oxygen tank, said knob protection portion being hingedly attached to said protective cover and thereby configured to swing away from said adjustment knob to provide free access thereto;

f) said tank attachment member comprising: (i) a pair of elongated brackets fixedly attached to either side of said oxygen tank by way of heat resistant double sided adhesive tape; (ii) a mating pair of elongated brackets fixedly attached to an inside portion of said rigid cover member and adapted to slide onto said pair of elongated brackets attached to either side of said oxygen tank to secure said tank holding portion of said rigid protective cover member to said oxygen tank; and (iii) a rail stop adapted to prevent said rigid protective cover member from sliding when on said oxygen tank; and g) a plurality of low friction slide rails constructed of material that has a low coefficient of friction, said slide rails being fixedly and longitudinally attached to an outside portion of said protective cover for sliding contact with a ground surface or stairs while being used in an emergency.

2. A protective cover for an emergency worker as recited by claim 1, wherein said rigid protective cover member forms a rigid frame and comprises straps and is appointed to be strapped onto a back of said emergency worker.

3. A protective cover for an emergency worker oxygen tank as recited by claim 1, wherein said attachment member includes a flexible strap for further securing said rigid protective cover member to said oxygen tank.

4. A protective cover for an emergency worker oxygen tank as recited by claim 1, wherein said tank attachment member comprises a clamping assembly adapted to engage a neck of said oxygen tank.

5. A protective cover for an emergency worker oxygen tank as recited by claim 1, wherein said tank attachment member comprises a hinge member or at least one strap or tab adapted to be attached to a portion of said tank supporting frame.

6. A protective cover for an emergency worker oxygen tank having an adjustment knob, comprising:

a) a rigid protective cover member comprising a tank holding portion and a knob protection portion, said knob protection portion having an extension tab configured to operate as a stop to prevent said knob protection portion from contacting said adjustment knob during use;

b) a tank attachment member;

c) said tank attachment member fixedly attached to said rigid protective cover member;

d) said tank attachment member adapted to be securely attached to a portion of a standard oxygen tank or to a portion of a supporting frame for said oxygen tank appointed to be used by an emergency worker;

e) said knob protection portion adapted to extend around and over an adjustment knob portion of said oxygen tank, said knob protection portion having an arced shape and a cupped interior, and being adapted to receive and cradle said adjustment knob portion to thereby extend over only a portion thereof and provide access to said adjustment knob so that said adjustment knob can be adjusted without having to remove said knob protection portion from said oxygen tank, said knob protection portion being hingedly attached to said protective cover and thereby configured to swing away from said adjustment knob to provide free access thereto;

f) said rigid protective cover member being fixed in place onto said oxygen tank by high temperature rated double side adhesive tape;

g) said tank attachment member comprising: (i) a pair of elongated brackets fixedly attached to either side of said oxygen tank by way of heat resistant double sided adhesive tape; (ii) a mating pair of elongated brackets fixedly attached to an inside portion of said rigid cover member and adapted to slide onto said pair of elongated brackets attached to either side of said oxygen tank to secure said tank holding portion of said rigid protective cover member to said oxygen tank; and (iii) a rail stop adapted to prevent said rigid protective cover member from sliding when on said oxygen tank; and h) a plurality of low friction slide rails constructed of material that has a low coefficient of friction, said slide rails being fixedly and longitudinally attached to an outside portion of said protective cover for sliding contact with a ground surface or stairs while being used in an emergency.

7. A protective cover for an emergency worker oxygen tank as recited by claim 1, comprising at least one strap adapted to be released and attached by standard fastening clips to secure said oxygen tank.

8. A protective cover for an emergency worker oxygen tank as recited by claim 1, wherein said rigid protective cover member is composed of a light weight metal.

9. A protective cover for an emergency worker oxygen tank as recited by claim 1, wherein said rigid protective cover member is composed of a high heat polymer.

10. A protective cover for an emergency worker oxygen tank having an adjustment knob, comprising:

a) a rigid protective cover member formed having a main body portion, a neck portion and a knob cover extension portion, said rigid protective cover adapted to receive and extend around at least a portion of an oxygen tank;

b) a tank attachment member fixedly integrated with said rigid cover member, said tank attachment member adapted to be securely attached to a portion of a standard oxygen tank appointed to be used by an emergency worker; and c) a knob protection portion adapted to extend around and over an adjustment knob portion of said oxygen tank to protect said adjustment knob portion, said knob protection portion having an arced shape and a cupped interior, and being adapted to receive and cradle said adjustment knob portion to thereby extend over only a portion thereof and provide access to said adjustment knob so that said adjustment knob can be adjusted without having to remove said knob protection portion from said oxygen tank, said knob protection portion being hingedly attached to said protective cover and thereby configured to swing away from said adjustment knob to provide free access thereto, said knob protection portion having an extension tab configured to operate as a stop to prevent said knob protection portion from contacting said adjustment knob during use;

d) said rigid protective cover member being composed of a high heat fiberglass;

e) said tank attachment member comprising: (i) a pair of rails elongated brackets fixedly attached to either side of said oxygen tank by way of heat resistant double sided adhesive tape; (ii) a mating pair of elongated brackets fixedly attached to an inside portion of said rigid cover member and adapted to slide onto said pair of elongated brackets attached to either side of said oxygen tank to secure said tank holding portion of said rigid protective cover member to said oxygen tank; and (iii) a rail stop adapted to prevent said rigid protective cover member from sliding when on said oxygen tank; and e) a plurality of low friction slide rails being mounted on an outside of said rigid protective cover member for sliding contact with a ground surface or stairs while being used in an emergency.

11. A protective cover for an emergency worker as recited by claim 10, wherein said main body portion, neck portion and knob cover extension are fixedly attached to one another.

12. A protective cover for an emergency worker oxygen tank having an adjustment knob, comprising:

a) a rigid protective cover member comprising a tank holding portion and a knob protection portion;

b) a tank attachment member;

c) said tank attachment member fixedly attached to said rigid protective cover member;

d) said tank attachment member adapted to be securely attached to a portion of a standard oxygen tank or to a portion of a supporting frame for said oxygen tank appointed to be used by an emergency worker;

e) said tank holding portion of said rigid protective cover member adapted to cover only a portion of said oxygen tank and extending to form a knob protection portion adapted to extend around and over an adjustment knob portion of said oxygen tank, said knob protection portion formed as an arced portion having a cupped interior that is adapted to receive and cradle said adjustment knob portion to thereby extend over only a portion thereof and provide access to said adjustment knob so that said adjustment knob portion is protected while access to said adjustment knob portion is readily provided without having to remove said knob protection portion from said oxygen tank, said knob protection portion being hingedly attached to said protective cover and thereby configured to swing away from said adjustment knob to provide free access thereto, said knob protection portion having an extension tab configured to operate as a stop to prevent said knob protection portion from contacting said adjustment knob during use;

f) said rigid protective cover member being composed of a high heat polycarbonate that can tolerate temperatures of at least 1000 deg. F.;

g) said tank attachment member comprising: (i) a pair of elongated brackets fixedly attached to either side of said oxygen tank by way of heat resistant double sided adhesive tape; (ii) a mating pair of elongated brackets fixedly attached to an inside portion of said rigid cover member and adapted to slide onto said pair of elongated brackets attached to either side of said oxygen tank to secure said tank holding portion of said rigid protective cover member to said oxygen tank; and (iii) a rail stop adapted to prevent said rigid protective cover member from sliding when on said oxygen tank; and h) a plurality of low friction slide rails constructed of material that has a low coefficient of friction, said slide rails being fixedly and longitudinally attached to an outside portion of said protective cover for sliding contact with a ground surface or stairs while being used in an emergency.

* * * * *